US008125502B2

(12) United States Patent
Lu et al.

(10) Patent No.: US 8,125,502 B2
(45) Date of Patent: Feb. 28, 2012

(54) METHOD FOR DRIVING A PIXEL BY GENERATING AN OVER-DRIVE GREY LEVEL AND DRIVER THEREOF

(75) Inventors: Wen-Min Lu, Hsinchu (TW); Ming-Sung Huang, Hsinchu County (TW); Pei-Ting Tsai, Taitung (TW)

(73) Assignee: Etron Technology, Inc., Hsinchu (TW)

( * ) Notice: Subject to any disclaimer, the term of this patent is extended or adjusted under 35 U.S.C. 154(b) by 849 days.

(21) Appl. No.: 12/127,809

(22) Filed: May 27, 2008

(65) Prior Publication Data

US 2009/0244103 A1 Oct. 1, 2009

(30) Foreign Application Priority Data

Mar. 26, 2008 (TW) ..... 97110740 A

(51) Int. Cl.
*G09G 5/10* (2006.01)

(52) U.S. Cl. ..... 345/690; 345/89; 345/77; 345/63

(58) Field of Classification Search ..... 345/87–104, 345/690–699, 76–84, 204–215; 315/169.1–169.4
See application file for complete search history.

(56) References Cited

U.S. PATENT DOCUMENTS

| | | | | |
|---|---|---|---|---|
| 6,795,581 | B1 * | 9/2004 | Nomura | 382/232 |
| 2004/0027322 | A1 * | 2/2004 | Chen et al. | 345/89 |
| 2006/0028419 | A1 * | 2/2006 | Lee et al. | 345/98 |
| 2006/0219700 | A1 | 10/2006 | Chen et al. | |
| 2007/0018934 | A1 * | 1/2007 | Kim et al. | 345/98 |
| 2007/0222726 | A1 * | 9/2007 | Chen et al. | 345/87 |

* cited by examiner

*Primary Examiner* — Bipin Shalwala
*Assistant Examiner* — Jonathan King
(74) *Attorney, Agent, or Firm* — Winston Hsu; Scott Margo

(57) ABSTRACT

A method for generating an over-drive grey level for driving a pixel includes providing a corresponding over-drive function according to an original grey level for the pixel in the previous frame, and generating the over-drive grey level according to the corresponding over-drive function and the original grey level for the pixel in the current frame.

11 Claims, 7 Drawing Sheets

| | Raw over-drive table | | | | | | | | | | | |
|---|---|---|---|---|---|---|---|---|---|---|---|---|
| F2 \ F1 | 0 | 1 | 2 | 3 | 4 | 5 | 6 | 7 | 8 | 9 | ····· | 255 |
| 0 | 0 | ··· | ··· | ··· | ··· | ··· | ··· | ··· | ··· | ··· | ····· | ··· |
| 1 | 2 | ··· | ··· | ··· | ··· | ··· | ··· | ··· | ··· | ··· | ····· | ··· |
| 2 | 3 | ··· | ··· | ··· | ··· | ··· | ··· | ··· | ··· | ··· | ····· | ··· |
| 3 | 4 | ··· | ··· | ··· | ··· | ··· | ··· | ··· | ··· | ··· | ····· | ··· |
| 4 | 6 | ··· | ··· | ··· | ··· | ··· | ··· | ··· | ··· | ··· | ····· | ··· |
| 5 | 8 | ··· | ··· | ··· | ··· | ··· | ··· | ··· | ··· | ··· | ····· | ··· |
| 6 | 11 | ··· | ··· | ··· | ··· | ··· | ··· | ··· | ··· | ··· | ····· | ··· |
| 7 | 15 | ··· | ··· | ··· | ··· | ··· | ··· | ··· | ··· | ··· | ····· | ··· |
| 8 | 19 | ··· | ··· | ··· | ··· | ··· | ··· | ··· | ··· | ··· | ····· | ··· |
| 9 | 25 | ··· | ··· | ··· | ··· | ··· | ··· | ··· | ··· | ··· | ····· | ··· |
| ⋮ | ⋮ | ⋮ | ⋮ | ⋮ | ⋮ | ⋮ | ⋮ | ⋮ | ⋮ | ⋮ | ⋮ | ⋮ |
| 255 | ··· | ··· | ··· | ··· | ··· | ··· | ··· | ··· | ··· | ··· | ····· | ··· |

FIG. 1 PRIOR ART

| Reduced over-drive table | | | | | | | | | |
|---|---|---|---|---|---|---|---|---|---|
| F2 \ F1 | 0 | 32 | 64 | 96 | 128 | 160 | 192 | 224 | 255 |
| 0 | 0 | 38 | 79 | 122 | 162 | 195 | 227 | 248 | 255 |
| 32 | 0 | 32 | 70 | 109 | 149 | 186 | 219 | 245 | 255 |
| 64 | 0 | 28 | 64 | 103 | 143 | 180 | 215 | 243 | 255 |
| 96 | 0 | 26 | 59 | 96 | 135 | 174 | 210 | 240 | 255 |
| 128 | 0 | 24 | 55 | 90 | 128 | 168 | 206 | 239 | 255 |
| 160 | 0 | 22 | 51 | 83 | 120 | 160 | 200 | 236 | 255 |
| 192 | 0 | 20 | 46 | 75 | 110 | 149 | 192 | 231 | 255 |
| 224 | 0 | 16 | 39 | 66 | 98 | 136 | 181 | 224 | 255 |
| 255 | 0 | 11 | 30 | 55 | 84 | 120 | 165 | 210 | 255 |

FIG. 2 PRIOR ART

METHOD FOR DRIVING A PIXEL BY GENERATING AN OVER-DRIVE GREY LEVEL AND DRIVER THEREOF

BACKGROUND OF THE INVENTION

1. Field of the Invention

The present invention relates to a method for driving a pixel by an over-drive grey level and related driver, and more particularly, to a method for driving a pixel by a corresponding over-drive grey level generated from mathematical operation and related driver.

2. Description of the Prior Art

Please refer to FIG. 1. FIG. 1 is a diagram illustrating a raw over-drive table for looking up over-drive grey levels to over-drive a pixel with the corresponding over-drive grey level looked up in the raw over-drive table. Generally, for enhancing response time of liquid crystal particles in a Liquid Crystal Display (LCD), manner of over-driving is used when liquid crystal particles are driven. The liquid crystal particles of one pixel of the LCD can be driven with a corresponding over-drive grey level according to the original grey levels for the pixel in a current frame and the frame previous to the current frame. An appropriate over-drive grey level can be looked up in the over-drive table as illustrated in FIG. 1 and is used to drive the pixel for enhancing the response time of the pixel. As shown in FIG. 1, F1 (column) represents the original grey level for one pixel in one frame (the previous frame), and F2 (row) represents the original grey level for the pixel in the frame next to the frame (the current frame). Under the condition that one color is divided into 256 grey levels (8 bits), the raw over-drive table sizes up to 256×256×256 bits (equals to 32 Kbytes). However, a normal driving chip for LCD cannot afford that big size to store all the data of the over-drive grey levels.

Please refer to FIG. 2. FIG. 2 is a diagram illustrating an over-drive table after reduction. As shown in FIG. 2, the data in the table of FIG. 2 are reduced by decreasing the resolution of the table of FIG. 1 and abandoning some data in the table of FIG. 1. For example, if the original grey level for one pixel in the previous frame falls in the range between the grey levels "0"~"32", and the original grey level for that pixel in the current frame falls in the range between the grey levels "32"~"64", the corresponding over-drive grey level is grey level "0". In this way, the over-drive table of FIG. 2 can be reduced to 8×8×256 bits (64 bytes), which is obviously much smaller than the raw over-drive table of FIG. 1. However, the reduction from the table of FIG. 1 to the table of FIG. 2 results in insufficiently over-driving, decreasing the response time of the liquid crystal particles, and distortion in the displayed frames.

SUMMARY OF THE INVENTION

The present invention provides a method for generating an over-drive grey level to drive a pixel. The method comprises (a) according to an original grey level for the pixel in a previous frame, providing a corresponding over-drive function, and (b)

generating the over-drive grey level according to an original grey level for the pixel in a current frame and the corresponding over-drive function. The previous frame is a frame previous to the current frame.

The present invention further provides a driver for generating an over-drive grey level to drive a pixel. The driver comprises a function providing device for providing a corresponding over-drive function according to an original grey level for the pixel in a previous frame, and an over-drive-grey-level generating device for generating the over-drive level according to an original grey level for the pixel in a current frame and the corresponding over-drive function. The previous frame is a frame previous to the current frame.

The present invention further provides a method for generating an over-drive grey level to drive a pixel. The method comprises (a) according to an original grey level for the pixel in a previous frame, an original grey level for the pixel in a current frame, and an over-drive function, generating the over-drive grey level. The previous frame is a frame previous to the current frame.

The present invention further provides a driver for generating an over-drive grey level to drive a pixel. The driver comprises an over-drive-grey-level generating device for generating the over-drive level according to an original grey level for the pixel in a previous frame, an original grey level for the pixel in a current frame, and an over-drive function, and a pixel driving device for driving the pixel with the over-drive grey level. The previous frame is a frame previous to the current frame.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 1 is a diagram illustrating a raw over-drive table.

FIG. 2 is a diagram illustrating an over-drive table after reduction.

DETAILED DESCRIPTION

Therefore, the present invention provides a method to replace the conventional method for over-driving with the lookup table. In this way, the size of the over-drive table needed in the present invention can be efficiently reduced.

Please continue referring to FIG. 2. When the original grey level of a pixel in the previous frame falls within the range from "32" to "64" (the second column), the over-drive grey levels corresponding to different original grey levels for the pixel in the current frame stored in the table of FIG. 2 are "0", "32", "70", "109", "149", "186", "219", "245", and "255". According to a first embodiment of the present invention, under the condition that an original grey level of a pixel in the previous frame is known (ranging from "32" to "64", for example), the relation between an original grey level and an over-drive grey level for the pixel in the current frame can be described with a cubic equation in one unknown. The equation is described as follows:

$$OD(X)=aX^3+bX^2+cX+d \quad (1),$$

where OD(X) represents the over-drive grey level, X represents the original grey level for the pixel in the current frame.

In equation (1), coefficients "a", "b", "c", and "d" can be derived from the known over-drive grey pixels "0", "32", "70", "109", "149", "186", "219", "245", and "255", shown in the second column of the table in FIG. 2. The manner to derive the coefficients "a", "b", "c", and "d" from the known over-drive grey levels can be, for example, regression. Thus, in this embodiment, a predetermined set of the coefficients "a", "b", "c", and "d" for the equation (1) corresponds to a set of known over-drive grey levels for a known original grey level of a pixel in a previous frame (for example, the second column of the table in FIG. 2). However, the set of the values of the coefficient "a", "b", "c", and "d" for one known original grey level of a pixel in a previous frame is possibly same as the set of the values of the coefficient "a", "b", "c", and "d" for another known original grey level for the pixel in the previous frame.

Figure 3:
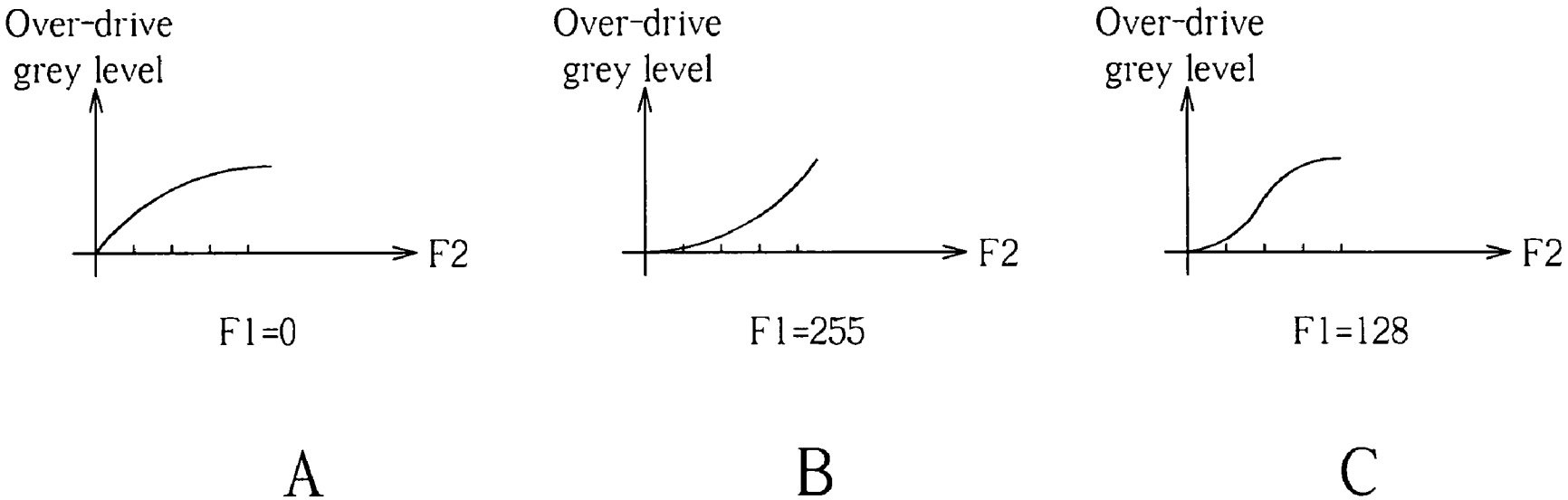
FIG. 3 is a diagram illustrating the relation between the over-drive grey level for a pixel to display in the current frame and the original grey level for the pixel in the current frame.

FIG. 3 is a diagram illustrating the relation between the over-drive grey level for a pixel to display in the current frame and the original grey level for the pixel in the current frame. As shown in FIG. 3A, if one color is divided into 256 grey levels (8 bits), when the original grey level of a pixel in a previous frame is "0", the relation between the over-drive grey level for a pixel to display in the current frame and the original grey level for the pixel in the current frame can be described as a first function. As shown in FIG. 3B, if one color is divided into 256 grey levels (8 bits), when the original grey level of a pixel in a previous frame is "255", the relation between the over-drive grey level for a pixel to display in the current frame and the original grey level for the pixel in the current frame can be described as a second function. As shown in FIG. 3C, if one color is divided into 256 grey levels (8 bits), when the original grey level for a pixel in a previous frame is "128", the relation between the over-drive grey level for a pixel to display in the current frame and the original grey level for the pixel in the current frame can be described as a third function.

In the first embodiment of the present invention, after all sets of coefficients "a", "b", "c", and "d" corresponding to each original grey level for the pixel in the previous frame are generated, all sets of the coefficients "a", "b", "c", and "d" are stored into a memory device. That is, the store space in this embodiment are only required for all the sets of the coefficients "a", "b", "c", and "d". When the original grey level for the pixel in the previous frame is received, the corresponding values for the coefficients of the equation (1) can be looked up from the memory device. For example, when the original grey level for the pixel in the previous frame is "0", the corresponding values for the coefficients of the equation (1) respectively are $a_{(0)}$, $b_{(0)}$, $c_{(0)}$, and $d_{(0)}$, and thus the equation (1) can be expressed as: $OD(X)=a_{(0)}X^3+b_{(0)}X^2+c_{(0)}X+d_{(0)}$, as shown in FIG. 3A, and the coefficients $a_{(0)}$, $b_{(0)}$, $c_{(0)}$, and $d_{(0)}$ are stored in the memory device of the present invention. In this way, the over-drive grey level for the pixel in the current frame, in the condition that the original grey level for the pixel in the previous frame is "0", can be generated according to the original level for the pixel in the current frame and the equation (1) with the coefficients $a_{(0)}$, $b_{(0)}$, $c_{(0)}$, and $d_{(0)}$ as shown in FIG. 3A; the over-drive grey level for the pixel in the current frame, in the condition that the original grey level for the pixel in the previous frame is "255", can be generated according to the original level for the pixel in the current frame and the equation (1) with the coefficients $a_{(255)}$, $b_{(255)}$, $c_{(255)}$, and $d_{(255)}$ as shown in FIG. 3B; the over-drive grey level for the pixel in the current frame, in the condition that the original grey level for the pixel in the previous frame is "128", can be generated according to the original level for the pixel in the current frame and the equation (1) with the coefficients $a_{(128)}$, $b_{(128)}$, $c_{(128)}$, and $d_{(128)}$ as shown in FIG. 3C.

In the first embodiment of the present invention, since each set of the coefficients "a", "b", "c", and "d" corresponding an original grey level for the pixel in the previous frame is different from another, the relation between the original grey level for the pixel in the previous frame and the set of the coefficients can be further found. In other words, the coefficients "a", "b", "c", and "d" can be further expressed as functions a(Y), b(Y), c(Y), and d(Y) respectively for the variable "Y", where Y represents the original grey level for the pixel in the previous frame.

Therefore, a second embodiment of the present invention is further derived according to the description above. More particularly, the second embodiment of the present invention further expresses the over-drive table of FIG. 2 with a cubic equation in two unknowns. The equation is expressed as follows:

$$OD_{(X,Y)}=(e)X^3Y^3+(f)X^3Y^2+(g)X^3Y+(h)X^3+(i)X^2Y^3+(j)X^2Y^2+(k)X^2Y+(l)X^2+(m)XY^3+(n)XY^2+(o)XY+(p)X+(q)Y^3+(r)Y^2+(s)Y+(t) \quad (2),$$

where "e", "f", "g", "h", "i", "j", "k", "l", "m", "n", "o", "p", "q", "r", "s", and "t" are coefficients of the equation (2), Y represents the original grey level for the pixel in the previous frame, X represents the original grey level for the pixel in the current frame, and $OD_{(X,Y)}$ represents the over-drive grey level for the pixel in the current frame. In this way, for any original grey levels for the pixel in the previous frame and in the current frame, after the coefficients "e", "f", "g", "h", "i", "j", "k", "l", "m", "n", "o", "p", "q", "r", "s", and "t" for the equation (2) are obtained, the looking-up-in-the over-drive-table step is no longer needed, which means the over-drive table is not required for over-driving as well, and the corresponding over-drive grey level for the pixel in the current frame can be derived from the equation (2) according to the original grey level for the pixel in the previous frame (the unknown Y) and the original grey level for the pixel in the current frame (the unknown X).

Figure 4:
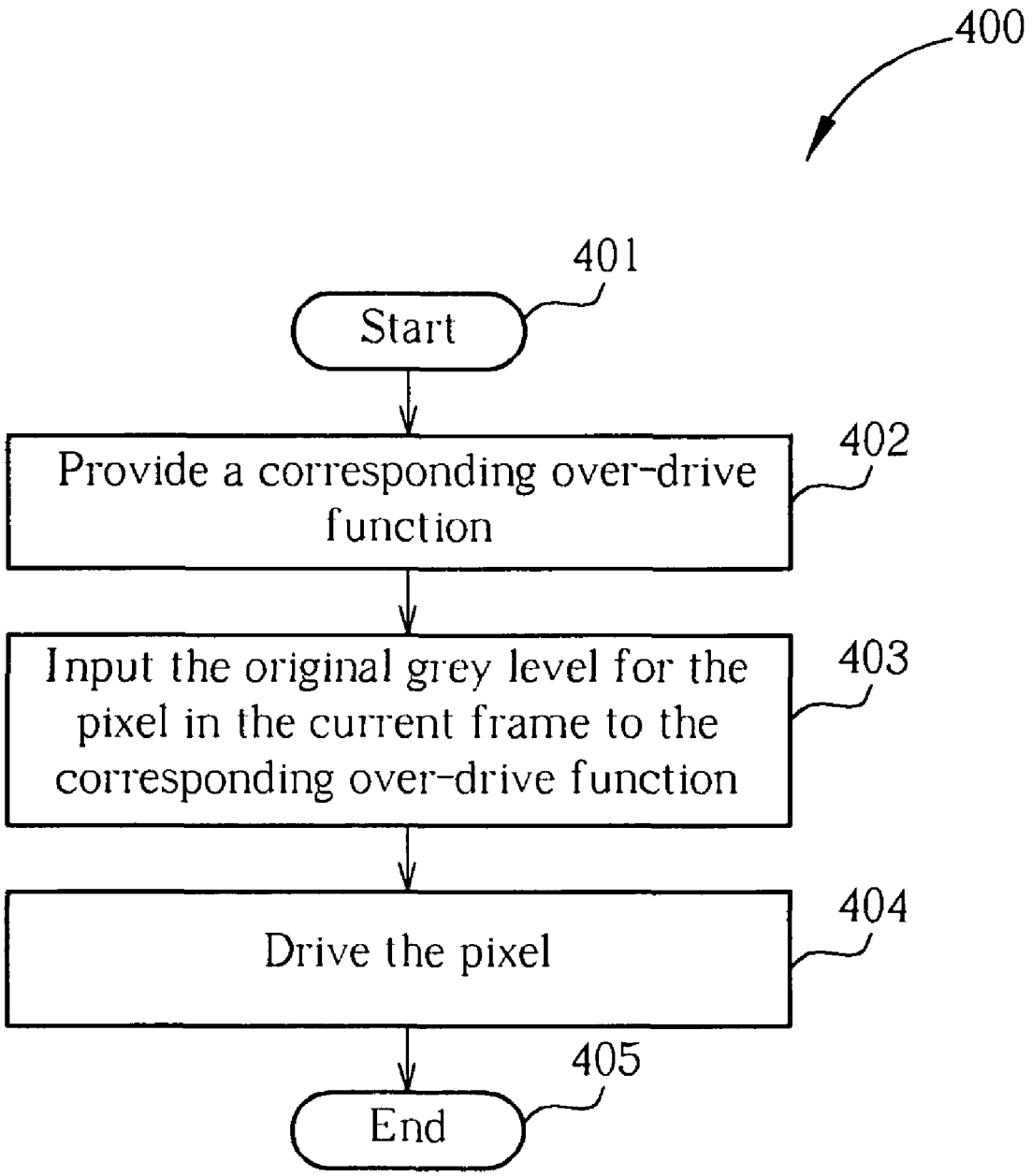
FIG. 4 is a flowchart of the method according to the first embodiment of the present invention.

Please refer to FIG. 4. FIG. 4 is a flowchart of the method 400 according to the first embodiment of the present invention. The steps are described as follows:

Step 401: Start;

Step 402: According to the original grey level for the pixel in the previous frame, provide a corresponding over-drive function;

Step 403: Input the original grey level for the pixel in the current frame to the corresponding over-drive function provided in step 402 in order to generate a corresponding over-drive grey level for the pixel to display in the current frame;

Step 404: Drive the pixel with the over-drive grey level generated in step 403;

Step 405: End.

Step 402, according to the original grey level for the pixel in the previous frame, finds corresponding coefficients of a cubic equation in one unknown such as equation (1) from the memory device.

Step 403 inputs the original grey level for the pixel in the current frame to the function generated from the step 402. In this way, the desired over-drive grey level for the pixel to display in the current frame can be obtained.

Step 404 drives the pixel with the over-drive grey level generated from step 403 for completing over-driving the pixel.

Figure 5:
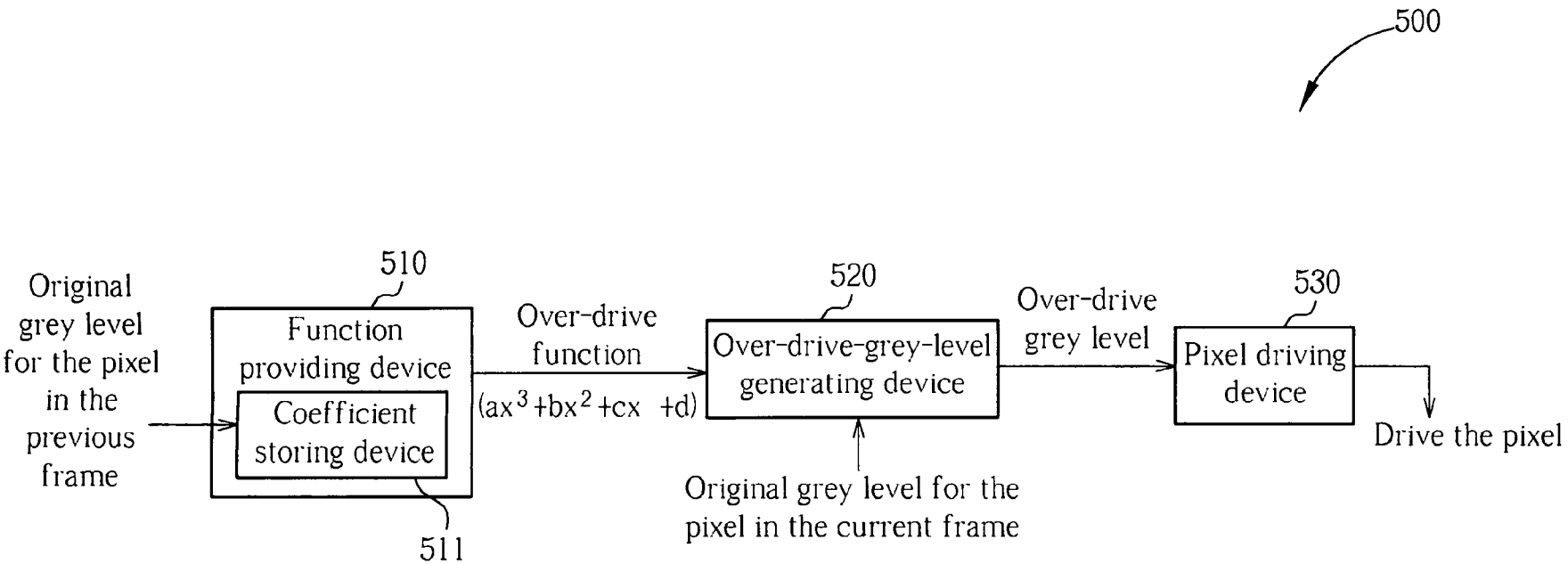
FIG. 5 is a driver according to the first embodiment of the present invention.

Please refer to FIG. 5. FIG. 5 is a driver 500 according to the first embodiment of the present invention. As shown in FIG. 5, the driver 500 comprises a function providing device 510, an over-drive-grey-level generating device 520, and a pixel driving device 530. The function providing device 510, according to the original grey level for the pixel in the previous frame, provides a corresponding over-drive function. The function providing device 510 comprises a coefficient storing device for storing the predetermined coefficients of the corresponding over-drive function. The corresponding over-drive function can be a cubic equation in one unknown. Thus, the function providing device 510 can look up the predetermined coefficients, required for the cubic equation in one unknown, in the coefficient storing device 511. The over-drive-grey-level generating device 520, according to the original grey level for the pixel in the current frame and the provided over-drive function, generates a corresponding over-drive grey level for the pixel to display in the current frame. The pixel driving device 530 uses the over-drive grey level generated from the over-drive-grey-level generating device 520 to drive the pixel in order to achieve over-driving purpose.

Figure 6:
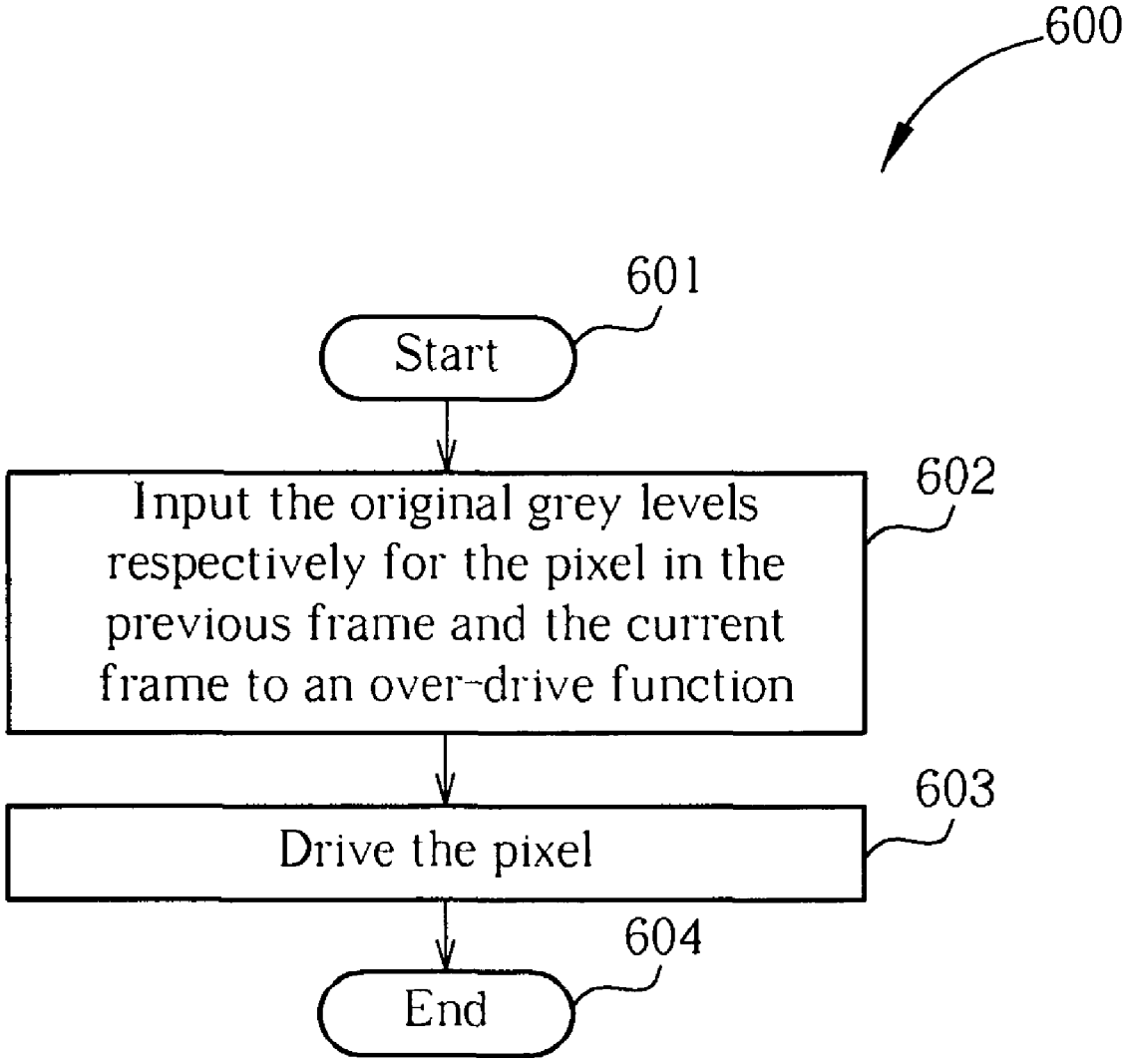
FIG. 6 is a flowchart illustrating a method according to the second embodiment of the present invention.

Please refer to FIG. 6. FIG. 6 is a flowchart illustrating a method 600 according to the second embodiment of the present invention. The steps are described as follows:

Step 601: Start;

Step 602: Input the original grey levels respectively for the pixel in the previous frame and the current frame to an over-drive function for generating a corresponding over-drive grey level for the pixel to display in the current frame;

Step 603: Use the over-drive grey level generated in step 602 to drive the pixel;

Step 604: End.

Step 602 inputs the original grey levels respectively for the pixel in the previous frame and the current frame to a cubic equation in two unknown such as equation (2) for generating a corresponding over-drive grey level for the pixel to display in the current frame. Then step 603 uses the over-drive grey level generated in step 602 to drive the pixel in order to achieve over-driving purpose.

Figure 7:
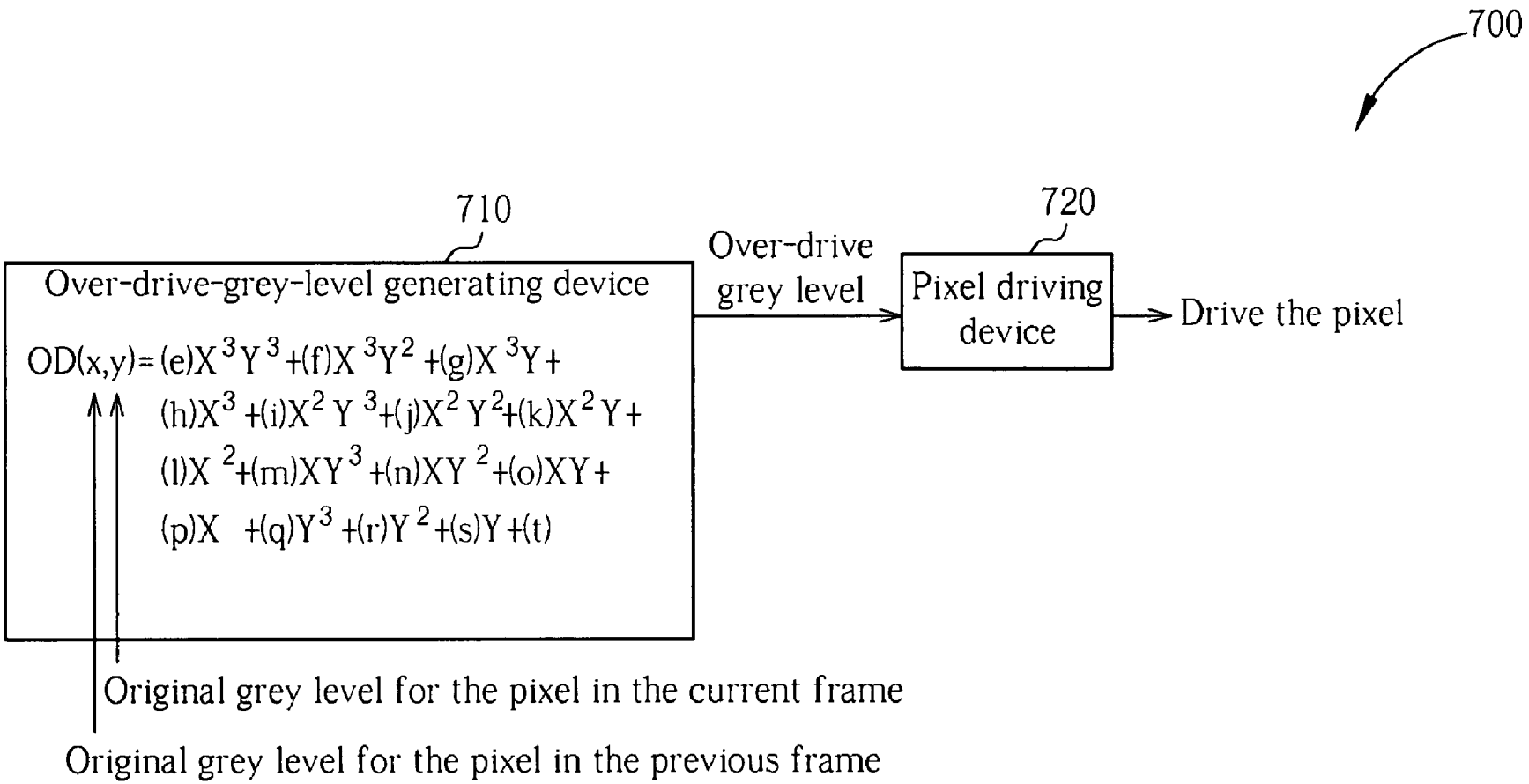
FIG. 7 is a diagram illustrating a driver according to the second embodiment of the present invention.

Please refer to FIG. 7. FIG. 7 is a diagram illustrating a driver 700 according to the second embodiment of the present invention. As shown in FIG. 7, the driver 700 comprises an over-drive-grey-level generating device 710 and a pixel driving device 720. The over-drive-grey-level generating device 710 receives the original grey levels respectively for the pixel in the previous frame and the current frame, and then inputs the received grey levels to an over-drive function. The over-drive function used by the over-drive-grey-level generating device 710 can be a cubic equation in two unknowns, and the coefficients of the cubic equation in two unknowns are derived from a predetermined over-drive table. The pixel driving device 720 utilizes the over-drive grey level generated from the over-drive-grey-level generating device 710 to drive the pixel in order to achieve over-driving purpose.

To sum up, the method and the driver provided by the present invention effectively utilizes mathematical operation to generate over-drive grey levels required for the pixel so that the required memory space can be greatly reduced, providing great convenience.

Those skilled in the art will readily observe that numerous modifications and alterations of the device and method may be made while retaining the teachings of the invention.

What is claimed is:

1. A method for generating an over-drive grey level to drive a pixel, the method comprising:

(a) according to an original grey level for the pixel in a previous frame, providing a corresponding over-drive function; and (b) generating the over-drive grey level according to an original grey level for the pixel in a current frame and the corresponding over-drive function, wherein the corresponding over-drive function is a cubic equation having a single unknown variable being the original grey level for the pixel in the current frame;

wherein the previous frame is a frame previous to the current frame and coefficients of the corresponding over-drive function are predetermined according to a set of predetermined over-drive grey levels corresponding to the original grey level for the pixel in the previous frame.

2. The method of claim 1, further comprising:

(c) driving the pixel according to the over-drive grey level.

3. The method of claim 1, wherein providing the corresponding over-drive function comprising:

finding corresponding coefficients of the cubic equation in one unknown variable from a memory device according to the original grey level for the pixel in the previous frame; and providing the corresponding over-drive function according to the found corresponding coefficients of the cubic equation in one unknown variable and the cubic equation in one unknown variable.

4. A driver for generating an over-drive grey level to drive a pixel, the driver comprising:

a function providing device for providing a corresponding over-drive function according to an original grey level for the pixel in a previous frame; and an over-drive-grey-level generating device for generating the over-drive level according to an original grey level for the pixel in a current frame and the corresponding over-drive function, wherein the corresponding over-drive function is a cubic equation having a single unknown variable being the original grey level for the pixel in the current frame;

wherein the previous frame is a frame previous to the current frame, and coefficients of the corresponding over-drive function are determined according to the original grey level for the pixel in the previous frame.

5. The driver of claim 4, further comprising a pixel driving device for driving the pixel according to the over-drive grey level.

6. The driver of claim 4, wherein and the function providing device comprises a coefficient storing device for storing coefficients of the corresponding over-drive function.

7. A method for generating an over-drive grey level to drive a pixel, the method comprising:

(a) generating the over-drive grey level according to an original grey level for the pixel in a previous frame, an original grey level for the pixel in a current frame, and an over-drive function, wherein the over-drive function is a cubic equation having two unknown variables being the original grey level for the pixel in the current frame and the original grey level for the pixel in the previous frame;

wherein the previous frame is a frame previous to the current frame.

8. The method of claim 7, further comprising:

(b) driving the pixel according to the over-drive grey level.

9. The method of claim 7, wherein coefficients of the over-drive function are generated according to a predetermined over-drive table.

10. A driver for generating an over-drive grey level to drive a pixel, the driver comprising:

an over-drive-grey-level generating device for generating the over-drive level according to an original grey level for the pixel in a previous frame, an original grey level for the pixel in a current frame, and an over-drive function, wherein the over-drive function is a cubic equation having two unknown variables being the original grey level for the pixel in the current frame and the original grey level for the pixel in the previous frame; and a pixel driving device for driving the pixel with the over-drive grey level;

wherein the previous frame is a frame previous to the current frame.

11. The driver of claim 10, wherein coefficients of the over-drive function are generated according to a predetermined over-drive table.

* * * * *